United States Patent [19]

Trumbauer et al.

[11] Patent Number: 4,736,786

[45] Date of Patent: Apr. 12, 1988

[54] METHOD FOR IMPROVING STENGTH OF GASIFIABLE PATTERNS

[75] Inventors: David V. Trumbauer, Denver, Iowa; Larry L. Fosbinder, Moline, Ill.; Terry L. Erion, Janesville, Iowa

[73] Assignee: Deere & Company, Moline, Ill.

[21] Appl. No.: 815,167

[22] Filed: Dec. 31, 1985

[51] Int. Cl.[4] ..... B22D 9/04

[52] U.S. Cl. ..... 164/23; 164/34; 164/45; 164/228; 164/249; 164/230; 164/367

[58] Field of Search ..... 164/15, 23, 24, 33, 164/34, 35, 36, 45, 228, 230, 232, 235, 246, 249, 366, 367, 368, 369; 249/61, 62

[56] References Cited

U.S. PATENT DOCUMENTS

| | | | |
|---|---|---|---|
| Re. 31,488 | 1/1984 | Trumbauer | 164/34 |
| 2,752,653 | 7/1956 | Emblem et al. | 164/45 |
| 3,157,924 | 11/1964 | Smith | 164/34 |
| 3,374,824 | 3/1968 | Snelling | 249/62 |
| 3,889,737 | 6/1975 | Olsen | 249/62 |
| 4,043,379 | 8/1977 | Blazek | 164/23 |
| 4,240,492 | 12/1980 | Edwards et al. | 164/34 |
| 4,289,191 | 9/1981 | Myllymaki | 164/34 |
| 4,291,739 | 9/1981 | Baur | 164/34 |
| 4,448,235 | 5/1984 | Bishop | 164/34 |

*Primary Examiner*—Nicholas P. Godici
*Assistant Examiner*—Seidel Ricahrd K.

[57] ABSTRACT

A core assembly is formed by molding a destructible plastic form in abutting relation to a rigid bonded core. The core assembly can be used for casting large or long and thin castings. The rigid bonded core reinforces the plastic form against flexural and torsional forces as well as forces within the plastic tending to change the dimensional configuration of the plastic form.

27 Claims, 2 Drawing Sheets

METHOD FOR IMPROVING STENGTH OF GASIFIABLE PATTERNS

BACKGROUND OF THE INVENTION

The present invention relates to foundry tooling processes and methods for casting operations. More particularly, the present invention relates to forming a core assembly useful in casting operations known in the art as "full mold" casting.

The use of the full mold casting process can provide improved mold utilization, i.e., getting more castings per mold use, reduced sand preparation and handling, and reduced casting cleaning costs. Generally, the process involves the use of a gasifiable plastic pattern formed in the shape of the article to be cast. The pattern is located in a foundry mold and surrounded by unbonded sand. Usually, the sand is aerated when the pattern is first inserted into the mold. Special aerating equipment is thus required. When molten metal is cast into the mold, the metal vaporizes the pattern, thereby assuming its configuration as the cast article.

Problems are encountered with the full mold process when it is desired to make large and/or long and thin castings, such as crank shafts or transmission cases. Because of the physical characteristics of the plastic pattern, it undergoes significant deformation and bending when sand is packed around it in the foundry mold. Also, with intricate and irregularly shaped patterns it is difficult to fill unbonded sand in all required areas. Other malformations occur in the plastic pattern between the time it is formed and the time the metal is cast due to significant dimensional changes in the pattern, such as by shrinkage of the plastic material. These problems have therefore made it impractical to utilize the full mold technique for large and/or long and thin castings.

Various methods have been suggested by those in the art to strengthen molds. For example, U.S. Pat. No. 4,043,379 discloses a "lost wax" casting process in which a wax pattern is formed in the configuration of the article to be cast, the wax form is surrounded by a hardenable material, the wax is melted out to leave a void, and molten metal is cast into the void to form the casting. This patent discloses molding the wax form about rigid reinforcing members which are removed after the wax is melted out. However, that process requires that the pattern be removed prior to casting of the metal.

U.S. Pat. No. 3,889,737 discloses filling a plastic pattern with loose sand which is then compacted to add stability to the pattern. This method, however, is applicable only to patterns in configurations which will hold loose sand; moreover, compacting the sand may actually exacerbate deformations in the pattern. U.S. Pat. No. 4,291,739 also suggests the use of loose sand, but in this case a vacuum is applied to the mold to stabilize the pattern. This method, however, excludes the use of a pattern having a solid core positioned in the interior thereof, as in the present invention; also, the force of the vacuum applied must be regulated so that it does not deform the pattern.

U.S. Pat. No. Re. 31,488 discloses a particularly efficacious method for forming intricate castings using gasifiable plastic patterns. This patent shows a mold assembly including an inner bonded sand core, a gasifiable thermoplastic pattern, and an outer bonded sand core for use in metal casting.

None of the aforementioned patents adequately prevents deformation of the plastic pattern while also preventing dimensional changes in the pattern due to shrinkage of the plastic nor provides a solution to the problems extant with the possible use of the full mold casting process to large or long and thin castings.

In view of the foregoing, it is an object of the present invention to provide a method for stabilizing plastic patterns useful in metal casting.

It is also an object of the present invention to stabilize such patterns against flexural and distortional forces as well as against dimensional changes.

It is also an object of the present invention to provide a method for casting large or long and thin castings by means of the full mold process.

It is a further object of the present invention to provide a core assembly having a stabilized plastic pattern which is useful in metal casting.

It is still a further object of the present invention to provide a method for producing such core assemblies.

Yet another object of the present invention is to provide a method of casting metal castings by means of such core assemblies.

SUMMARY OF THE INVENTION

In one aspect, the present invention provides a core assembly useful in casting metal, comprising: a rigid bonded inner core having an outer surface portion; a molded-in-place layer of destructible plastic material having an inner surface portion in abutting relation to said outer surface portion such that said plastic layer is dimensionally stabilized; said inner core and said plastic layer composing a core subassembly; and an outer unbonded core encompassing said subassembly in overlying relation to said inner core and said plastic layer.

In another aspect, the present invention provides a method for producing such core assemblies comprising the steps of: forming a rigid bonded inner core having an outer surface portion; molding a destructible layer of plastic material such that an inner surface portion of said plastic layer is in abutting relation to said outer surface portion to form a core subassembly whereby said plastic layer is dimensionally stabilized; and forming an outer unbonded core encompassing said core subassembly in overlying relation to said plastic layer and said inner core to form a core assembly.

In still another aspect of the present invention there is provided a method for casting metal castings comprising the steps of: forming a composite core assembly by: forming a rigid bonded inner core having an outer surface portion; molding a destructible layer of plastic material in abutting relation to said outer surface portion such that said plastic layer is dimensionally stabilized, so as to form a core subassembly composed of said inner core and said plastic layer; positioning said core subassembly in a mold cavity forming an outer unbonded core encompassing said core subassembly in overlying relation to said plastic layer and said inner core to form a composite core assembly; and introducing molten metal into said mold cavity to destroy said plastic layer and produce a casting.

In various preferred embodiments of the present invention, the inner core comprises sand and a binder, the inner core is hollow, and the plastic material comprises expanded polystyrene. In other preferred embodiments, the plastic layer is coated with a refractory core wash.

In general, the present invention relates to stabilizing a plastic pattern for use in casting processes by forming the pattern about a rigid bonded core such that the core dimensionally stabilizes the pattern. As heretofore mentioned, plastic patterns useful in full mold casting processes are susceptible to spatial and dimensional changes, and this susceptibility increases as the size of the plastic pattern increases. The present invention allows such patterns to be used in such casting processes as full mold even when such patterns are relatively large or long and thin.

In describing the invention, reference will be made to the preferred embodiments shown in the appended drawings in which.

DETAILED DESCRIPTION OF THE INVENTION

The present invention involves stabilizing a plastic pattern useful in full mold casting processes by forming the pattern about a rigid bonded core or cores such that the pattern is dimensionally stabilized. The term "dimensionally stabilized" as used herein, for purposes of the present invention, and with respect to the plastic pattern, connotes reinforcing the pattern against flexural and torsional forces tending to distort the pattern as well as forces within the plastic tending to change the dimensional configuration of the pattern. As previously noted, such patterns are subject to deformations during two stages of the full mold process; namely, dimensional changes after the plastic pattern is formed, such as by shrinkage of the plastic material, and deformation and bending due to torsional forces, such as caused by packing sand around the patterns in the foundry mold. These problems occur due to the inherent weakness or flexibility of the plastics used for the patterns, such as with polystyrene.

In producing a casting having an inner cavity or void, such as a hollow crank shaft or transmission case, an inner core is formed in the configuration of the cavity. Fabrication of the core may be carried out in any suitable manner; for instance, the inner core can be molded of silica sand and a binder, such as a phenolic base and/or modified phenolic base resin, by conventional techniques. It is, however, necessary that the rigid bonded inner core be rigid so that when the plastic layer is molded around it, the core can withstand forces tending to bend and deform the plastic pattern. The inner core must be "non-destructible" in that it can resist the effects of the molten metal being cast. The inner core must also be removable after the casting is produced. Hence, the inner core is preferably frangible so that it can be broken into pieces removable from the finished casting. The rigid bonded inner core must further maintain its dimensional integrity, i.e., the dimensions of the core must remain fixed. This is necessary so that shrinkage of the plastic layer molded in abutting relation thereto will be minimized, hence maintaining the dimensions of the formed plastic layer to provide a casting having the required dimensional tolerances.

Figure 1:
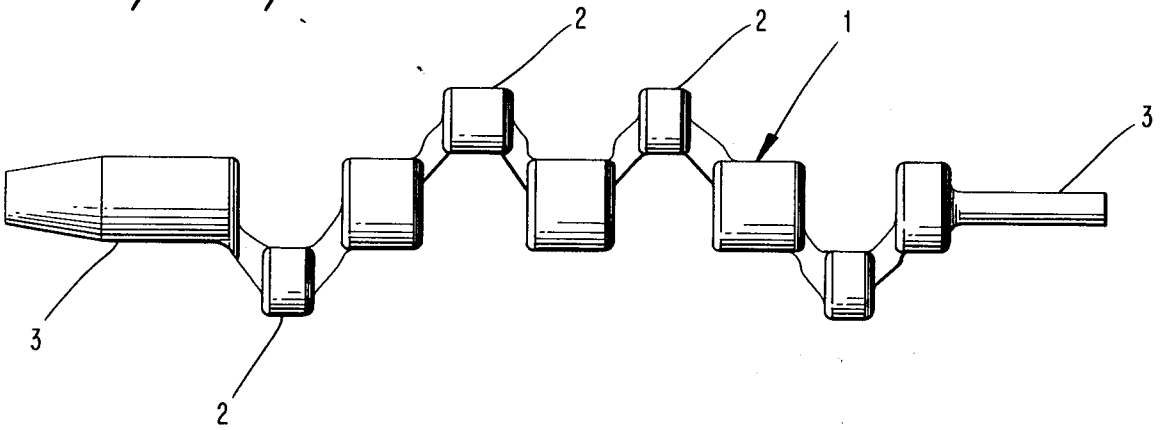
FIG. 1 is a view depicting the rigid inner core.

FIG. 1 depicts a rigid sand core 1 in the shape of a crank shaft having throws 2 and end portions 3. The irregular outer surface portion of the core 1 aids in dimensionally stabilizing the plastic layer formed thereabout.

It is possible that more than one rigid inner core will be required depending on the configuration of the article to be cast. For example, an article having two inner cavities will require two rigid inner cores.

Subsequent to forming the rigid bonded inner core, a layer of destructible plastic material is formed around the core. The expression "destructible" as applied to the plastic material is intended to designate materials which are quickly destroyed by molten metal, such as by vaporization, thereby enabling the molten metal to occupy the space originally occupied by the plastic. Among the materials which have been found satisfactory for the plastic are polystyrene, polyurethane, and resinous polymerized derivatives of methacrylic acid. It is preferred that the plastic material for use in the present invention comprises polystyrene. In general, the plastic material may comprise any suitable low temperature fusable material which gasifies substantially without residue upon contact with molten metal. The "destructible" nature of the plastic material is therefore contrary to the non-destructible characteristics of the core.

The destructible layer of plastic material can be molded in place around the rigid bonded inner core by placing the inner core in a molding machine and subsequently molding the plastic material thereabout. For example, partially pre-expanded polystyrene pellets can be introduced into the mold and fully expanded via a steam expansion, or other suitable and accepted method, around the inner core so as to form a destructible layer of plastic material having an inner surface portion contiguous and in abutting relation to an outer surface portion of the rigid inner core. The plastic layer is molded in accordance with the desired shape of the article to be cast.

The plastic layer encompasses a portion of the inner core such that it is permanently affixed thereto, i.e., the plastic layer cannot be moved in any direction. Moreover, the plastic layer is in abutting relation to the core. By this it is meant that various portions of the inner surface of the plastic layer are contiguous with various portions of the outer surface of the inner core such that the core supports the plastic layer against forces which tend to deform the plastic and against forces which tend to change the dimensions of the plastic layer. The abutting relation of the plastic layer and the inner core thereby provides support for the plastic layer and maintains its precise configuration. Polystyrene and other cellular plastics are subject to shrinkage between the time they are formed and the time the molten metal is cast. For example, polystyrene can shrink 0.001 feet in 30 days, 75% of the shrinkage occurring in the first five days. By the method of the present invention the plastic layer is dimensionally stabilized against such changes as may occur by shrinkage of the plastic material. Hence, the abutting relation of the plastic layer and the rigid bonded inner core dimensionally stabilizes the plastic layer.

Figure 2:
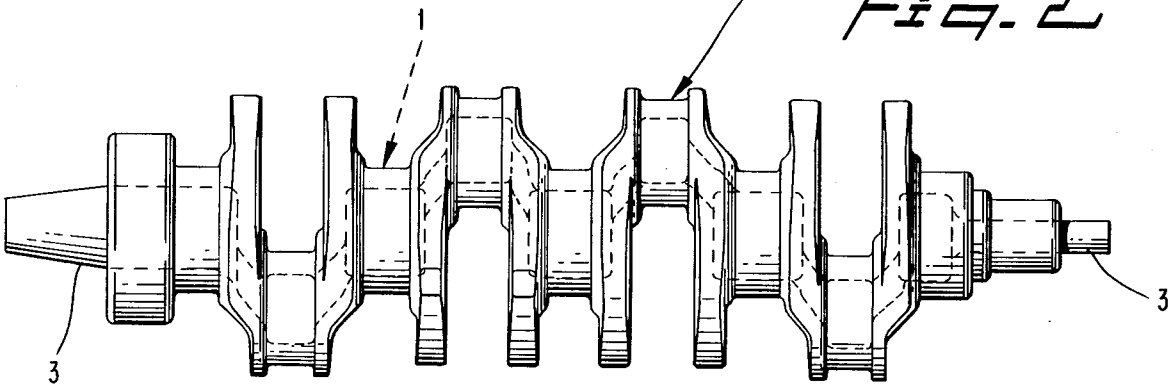
FIG. 2 is a view depicting the subassembly composed of the rigid inner core of FIG. 1 having a molded-in-place layer of destructible material thereabout.

The core subassembly can be seen depicted in FIG. 2, wherein the inner core 1 has formed thereabout a plastic layer 5 in the shape of the article to be cast (in this case, a crankshaft) and in abutting relation therewith.

The rigid bonded inner core and the plastic layer compose a core subassembly wherein the plastic layer is dimensionally stabilized by the rigid bonded inner core. The core subassembly can be handled as a one-piece unit. If required by the molding process used to form the plastic layer, the core subassembly can be dried, such as in a microwave oven, to remove any residual water which may exist when a steam expansion step is used to expand polystyrene pellets. Also, the core subassembly may be coated with a surface coating, e.g., a core wash material, such as by dipping, to provide a better surface finish for the metal casting produced.

It is preferred that the plastic layer be molded in place as a unitary structure as opposed to being assembled from various pieces which are glued together around the inner core. The advantages of such a process include the elimination of troublesome glue joints, which can lead to voids and imperfections caused by excess glue, and a better contact between the plastic layer and the inner core, thereby reinforcing the abutting relation between the two.

Figure 3:
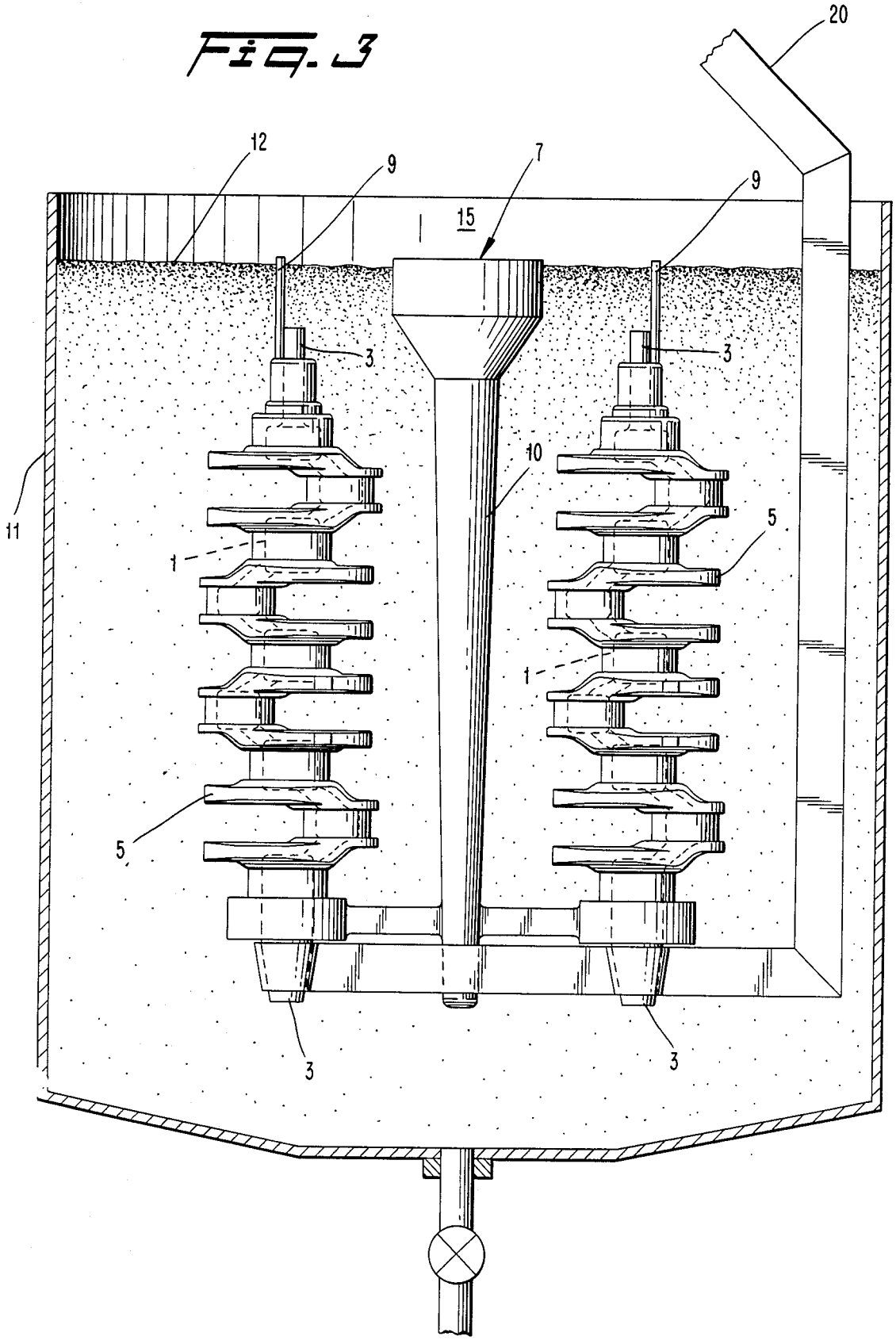
FIG. 3 is a view of the subassembly of FIG. 2 as used in a full mold casting process.

After the core subassembly has been formed, conventional full mold process techniques can be used. For example, as seen depicted in FIG. 3, the inner core 1 having the plastic layer 5 formed thereabout, i.e., the core subassembly, can be connected to a plastic, e.g., polystyrene, gate system 7 comprising a sprue 9 and a downriser 10, and then used in a conventional full mold process technique. Multiple core subassemblies 1 connected to a plastic gate system, are retained by support 20 and, optionally, coated with a refractory wash (not shown) to provide a better finish on the casting produced.

The multiple core subassemblies connected by the gate system 7, thereby defining multiple composite core assemblies, are inserted into a mold 11 and unbonded sand 12 is packed thereabout to form an outer core. Generally, the sand is first aerated (or fluidized) to assist in getting the sand to pack around all surfaces of the core. After the aeration is stopped, the sand packs tightly around the core. During the process of packing sand around the subassemblies, the plastic layer is subject to forces which tend to bend and deform the layer. However, by the present invention, the plastic layer is dimensionally stabilized against such forces by the abutting relation of the rigid bonded inner core and the plastic layer to avoid or at least minimize any such distortion. Suitable vent holes may be provided to allow the vapors from the gasified plastic material to escape.

After the unbonded sand is packed around the core subassembly to form a composite core assembly, molten metal is poured into the mold cavity whereby the plastic layer is gasified and replaced by the molten metal to form the casting.

It is preferred that the rigid bonded inner core be of unitary construction, and most preferred that the core be lightened, e.g., hollow, to provide material and weight savings. It should be noted that the "rigid bonded inner core" of the present invention as claimed denotes the final rigid bonded core useful in the method of the present invention as described herein. Various trip cores, such as oilways or oil drain slots for a cylinder block, may be formed as required, and then attached (for example, by glueing) to the rigid bonded inner core. The entire assembly as thus formed constitutes the rigid bonded inner core of the present invention.

It will be understood that the present invention is applicable to the production of any kind of metal casting using various types of metals and alloys.

The invention which is intended to be protected herein is not to be construed as limited to the particular forms disclosed; the above preferred embodiments are given to illustrate the spirit of the instant invention. Other embodiments within the scope and spirit of the present invention are also within the contemplation of this invention, and variations and changes may be made by those skilled in the art without departing from the spirit of the present invention.

What is claimed is:

1. A mold assembly useful in casting metal, comprising: a rigid inner core having an irregular outer surface portion; a molded-in-place layer of destructible plastic material having an irregular inner surface portion in abutting relation to said outer surface portion such that said plastic layer is dimensionally stabilized; said inner core and said plastic layer composing a core assembly; and an outer unbonded material encompassing said core assembly in overlying relation to said inner core and said plastic layer.

2. A mold assembly as defined by claim 1 further comprising a core wash material disposed about an outer surface portion of said plastic layer.

3. A mold assembly as defined by claim 1 further comprising a core wash material disposed about said inner surface portion of said plastic layer.

4. A mold assembly as defined by claim 1 wherein said plastic layer comprises expanded thermoplastic resinous pellets.

5. A mold assembly as defined by claim 4 wherein said thermoplastic resinous pellets comprise polystyrene.

6. A mold assembly as defined by claim 1 wherein said inner core is hollow.

7. A core assembly as defined by claim 1 wherein said molded-in-place layer is in the configuration of a crank shaft or a transmission case.

8. A mold assembly as defined by claim 1 wherein said rigid inner core comprises a bonded material.

9. A mold assembly as defined by claim 8 wherein said bonded material comprises sand and a binder.

10. A mold assembly as defined by claim 1 further comprising a core wash material disposed on said outer surface portion of said rigid inner core.

11. A method of forming a mold assembly useful in casting metal comprising the steps of: forming a rigid inner core having an irregular outer surface portion; molding a destructible layer of plastic material such that an irregular inner surface portion of said plastic layer is in abutting relation to said outer surface portion to form a core assembly whereby said plastic layer is dimensionally stabilized; and forming an outer unbonded material encompassing said core assembly in overlying relation to said plastic layer and said inner core to form the mold assembly.

12. A method as defined by claim 11 further comprising the step of coating said plastic layer with a core wash material subsequent to said molding step.

13. A method as defined by claim 11 wherein said step of molding comprises expanding thermoplastic resinous pellets to form said plastic layer.

14. A method as defined by claim 13 wherein said thermoplastic resinous pellets comprise polystyrene.

15. A method as defined by claim 11 wherein said inner core comprises sand and a binder.

16. A method as defined by claim 11 wherein said inner core is hollow.

17. A method as defined by claim 11 wherein said destructible layer is molded in the configuration of a crank shaft or a transmission case.

18. A method of casting metal castings comprising the steps of: forming a composite assembly by: forming an inner rigid core having an irregular outer surface portion; molding a destructible layer of plastic material in abutting relation to said outer surface portion such that said plastic layer is dimensionally stabilized, so as to form a core assembly composed of said inner core and said plastic layer; inserting said core assembly into a mold cavity; forming an outer unbonded material encompassing said core assembly in overlying relation to said plastic layer and said inner core to form a composite mold assembly; and introducing molten metal into said mold cavity to destroy said plastic layer and produce a casting.

19. A method as defined by claim 18 further comprising the step of coating said plastic layer with a core wash material subsequent to said molding step.

20. A method as defined by claim 18 wherein said inner core comprises sand and a binder.

21. A method as defined by claim 18 wherein said inner core is hollow.

22. A method as defined by claim 18 wherein said step of molding comprises expanding thermoplastic resinous pellets to form said plastic layer.

23. A method as defined by claim 22 wherein said thermoplastic resinous pellets comprise polystyrene.

24. A method as defined by claim 18 wherein said destructible layer is molded in the configuration of a crank shaft or a transmission case.

25. A method as defined by claim 18 further comprising the step of coating said inner rigid core with a core wash material prior to said molding step.

26. A mold assembly useful in casting metal, comprising: a first rigid core having an irregular surface portion; a molded-in-place layer of destructible plastic material having an irregular surface portion in abutting relation to said surface portion of said first rigid core whereby said plastic layer is dimensionally stabilized to form a core assembly, at least one portion of said rigid core extending beyond said molded-in-place layer of destructible plastic material; said core assembly being surrounded by an unbonded material; a support member at least partly disposed in said unbonded material; and said exposed portion of said rigid core being supported by said support member in the said unbonded material.

27. A cored assembly as defined by claim 20 wherein said molded-in-place layer is in the configuration of a crank shaft or a transmission case.

* * * * *

UNITED STATES PATENT AND TRADEMARK OFFICE

CERTIFICATE OF CORRECTION

PATENT NO. : 4,736,786

DATED : April 12, 1988

INVENTOR(S) : David Vernon Trumbauer et al

It is certified that error appears in the above-identified patent and that said Letters Patent is hereby corrected as shown below:

Claim 27, line 1, change "20" to --26 --.

Signed and Sealed this

Third Day of January, 1989

*Attest:*

DONALD J. QUIGG

*Attesting Officer*

*Commissioner of Patents and Trademarks*